US006450176B1

(12) United States Patent
Yokokawa

(10) Patent No.: US 6,450,176 B1
(45) Date of Patent: Sep. 17, 2002

(54) HAIR-WINDING TOOL AND HAIR WAVE-FORMING METHOD

(75) Inventor: Jun'ichi Yokokawa, Osaka (JP)

(73) Assignee: Juno Beauty Co., Ltd., Osaka (JP)

( * ) Notice: Subject to any disclaimer, the term of this patent is extended or adjusted under 35 U.S.C. 154(b) by 21 days.

(21) Appl. No.: 09/599,110

(22) Filed: Jun. 22, 2000

(30) Foreign Application Priority Data

Jun. 22, 1999 (JP) ..... 11-175851

(51) Int. Cl.[7] ..... A45D 2/08
(52) U.S. Cl. ..... 132/200; 132/250
(58) Field of Search ..... 132/200, 202, 132/203, 204, 207, 209, 210, 122, 129, 223, 226, 227, 228, 237, 238, 242, 245, 248, 250, 251, 254, 264, 266, 268, 211, 222, 253; D28/35, 37

(56) References Cited

U.S. PATENT DOCUMENTS 2,264,343 A * 12/1941 Solomon ..... 132/264
3,025,862 A * 3/1962 Insana ..... 132/250
3,045,685 A * 7/1962 Cormier ..... 132/250
D234,323 S * 2/1975 Demi ..... D28/37
D234,324 S * 2/1975 Demi ..... D28/37
4,130,122 A * 12/1978 Kennedy ..... 132/238
4,222,398 A * 9/1980 Fromman ..... 132/238
4,465,085 A * 8/1984 Schopieray ..... 132/248
4,498,489 A * 2/1985 Bornhauser ..... 132/245
4,513,760 A * 4/1985 Tihonovich ..... 132/245
4,699,160 A * 10/1987 Wiggin ..... 132/248
4,884,583 A * 12/1989 Long, Jr. ..... 132/238
4,913,900 A * 4/1990 Kole et al. ..... 424/72
D312,326 S * 11/1990 Johnson ..... D28/35
4,984,591 A * 1/1991 Jacobi ..... 132/229
5,350,572 A * 9/1994 Savaides et al. ..... 424/71
5,865,193 A * 2/1999 Fukomoto ..... 132/238

* cited by examiner

*Primary Examiner*—Todd E. Manahan
*Assistant Examiner*—David C. Comstock
(74) *Attorney, Agent, or Firm*—Keating & Bennett, LLP

(57) ABSTRACT

A hair-winding tool includes a rectangular hair-winding part having a flat surface portion. A pair of rotation-supporting parts are provided at both ends of the hair-winding part in its longitudinal direction. The rotation-supporting parts rotatably support the hair-winding part manually or automatically. The rotation-supporting part includes a cylindrical member. A plurality of engaging claws is disposed on an axial end of the cylindrical member such that the engaging claws are circumferentially spaced at desired intervals. An elastic holding member such as a rubber band can be engaged to a groove formed between the engaging claws. A novel zigzag hair wave is formed by winding hair on the hair-winding part of the hair-winding tool and performing cold permanent wave for the hair wound thereon.

14 Claims, 8 Drawing Sheets

HAIR-WINDING TOOL AND HAIR WAVE-FORMING METHOD

BACKGROUND OF THE INVENTION

1. Field of the Invention

The present invention relates to a hair-winding tool and a hair wave-forming method using the hair-winding tool. More particularly, the present invention relates to a hair-winding tool for use in cold wave and a hair wave-forming method using the hair-winding tool.

2. Description of the Prior Art

A conventional hair-waving rod, for the cold wave, which constitutes the background of the present invention is generally cylindrical.

Thus, in the cylindrical hair-waving rod, hair is wound along a curved surface thereof. Therefore, in the conventional cold wave, merely a curly hair wave is formed.

In recent years, the younger generation that likes a varied hairstyle is not satisfied with the conventional curly hair wave. That is, the conventional cold wave does not satisfy their desires.

SUMMARY OF THE INVENTION

Preferred embodiments of the present invention provide a hair-winding tool for forming a novel hair wave by cold wave and a hair wave-forming method using the hair-winding tool.

A hair-winding tool according to a preferred embodiment of the present invention is used for cold wave. The hair-winding tool includes a hair-winding part having a longitudinal direction and a flat surface portion.

A hair-winding tool according to another preferred embodiment of the present invention includes a pair of rotation-supporting parts provided at both ends of the hair-winding part in its longitudinal direction. Each rotation-supporting part rotatably supports the hair-winding part. The rotation-supporting parts have an engaging portion for engaging an annular and elastic holding member.

In a hair-winding tool according to another preferred embodiment of the present invention, the hair-winding part is configured in the shape of an approximately rectangular flat plate, and the rotation-supporting part includes a cylindrical member and the engaging portion includes a plurality of engaging claws disposed on an axial end of the cylindrical member such that the engaging claws are spaced at desired intervals.

In a hair-winding tool according to another preferred embodiment of the present invention, the hair-winding part has a passage provided thereon to allow a cold wave permanent lotion tribe used in the cold wave.

A hair-waving method according to a preferred embodiment of the present invention includes the steps of winding hair on a hair-winding part by using a hair-winding tool; and performing cold wave on the hair wound on the hair-winding part in the hair-winding step to form a zigzag hair wave.

According to the hair-winding tool of preferred embodiments of the present invention, hair is wound on the flat surface portion of the hair-winding part beginning at the tip portion thereof. Thus, the zigzag hair wave is produced.

According to a hair-winding tool of another preferred embodiment of the present invention, the hair-winding part is supported by a pair of the rotation-supporting parts disposed at both ends of the hair-winding part in its longitudinal direction. The hair-winding part is rotated manually in a desired direction by gripping both rotation-supporting parts. It is possible to rotate the hair-winding part automatically by using an electromotive hair-winding device. In this case, the one rotation-supporting part is lightly gripped, and a rotation shaft connected with a driving shaft of an electromotive motor of the electromotive hair-winding device is fitted to the other rotation-supporting part. In this case, the hair-winding part is rotatably supported by the rotation-supporting part.

To hold the hair on the flat surface portion of the hair-winding part in a wound state, an annular elastic holding member such as a rubber band is engaged to the engaging portion disposed on both rotation-supporting parts. Thereby, the hair is fixedly held on the hair-winding part in the wound state.

According to a hair-winding tool of another preferred embodiment of the present invention, the entire hair-winding part is configured in the shape of an approximately rectangular flat plate. Therefore, the hair can be wound effectively on the hair-winding part along the flat surface portion thereof. Further, because the engaging portion includes a plurality of the engaging claws, the holding member, such as a rubber band or other suitable members, is easily engaged in a groove provided between the adjacent engaging claws. Accordingly, it is easy to fix and retain the hair on the hair-winding part after the hair is wound thereon.

In a hair-winding tool according to another preferred embodiment of the present invention, the hair-winding part has the passage provided thereon to a cold wave permanent lotion to be used in the cold wave. Thus, first and second liquids of the cold wave permanent lotion permeate sufficiently into the hair in cold wave, thus allowing effective formation of the zigzag hair wave.

The hair-waving method according to preferred embodiments of the present invention includes the hair-winding step to be carried out by using any one of the above-described hair-winding tools. Thus, when cold wave is performed for the hair wound on the hair-winding tool, the novel zigzag hair wave can be formed.

The above and further objects, features, aspects, and advantages of the present invention will be more fully apparent from the following detailed description with the accompanying drawings.

DETAILED DESCRIPTION OF PREFERRED EMBODIMENTS

Figure 1:
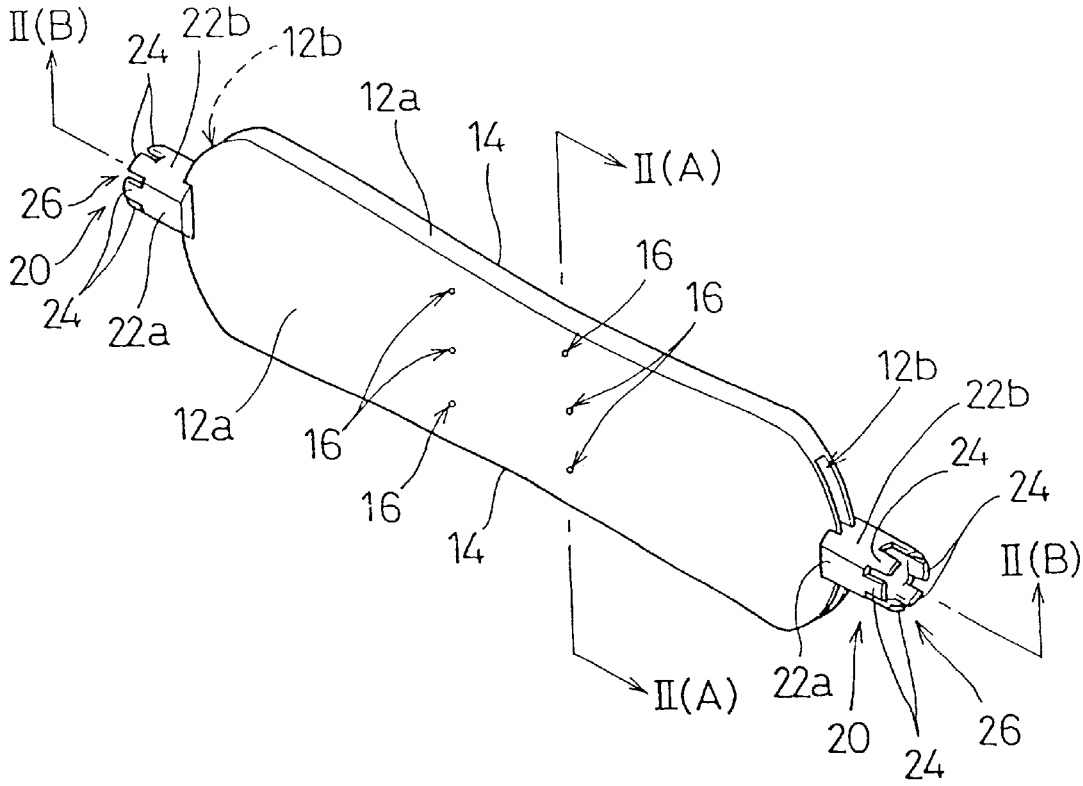
FIG. 1 is a perspective view showing a preferred embodiment of the hair-winding tool of the present invention.
Figure 2A:
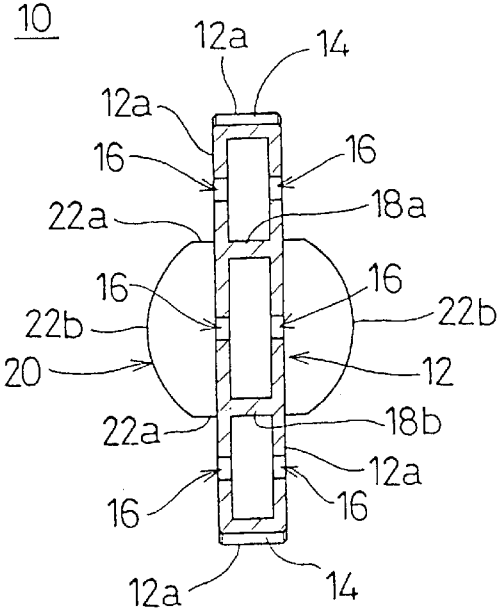
FIG. 2A is an enlarged sectional view taken along a line II(A)—II(A) of FIG. 1.
Figure 2B:
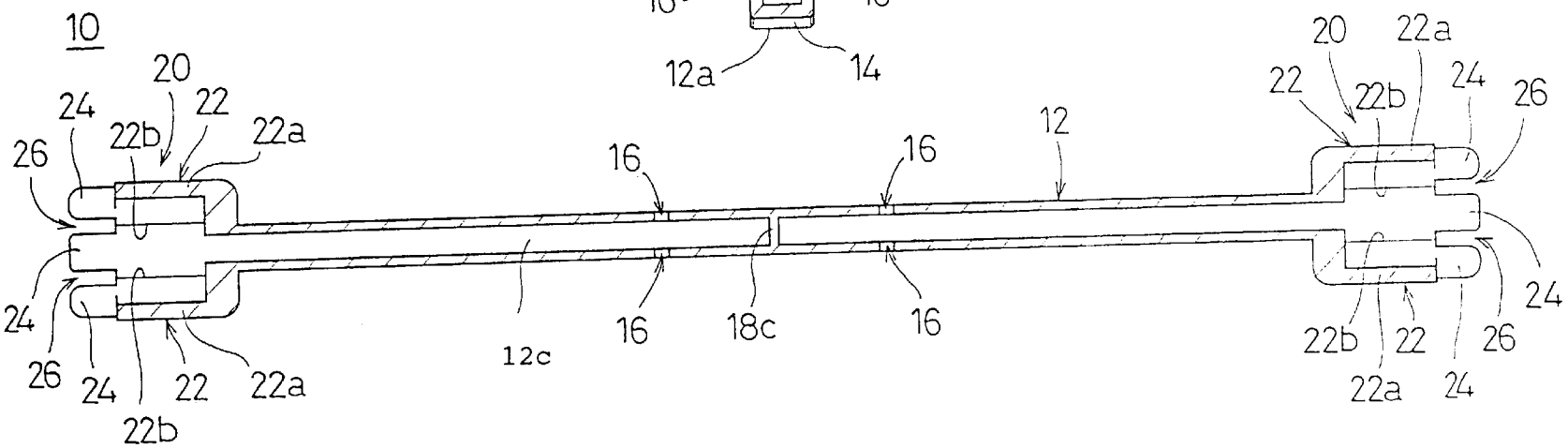
FIG. 2B is an enlarged sectional view taken along a line II(B)—II(B) of FIG. 1

In the following, preferred embodiments of the hair-winding tool and the hair wave-forming method using the hair-winding tool according to the present invention will be described with reference to the accompanying drawings FIG. 1 is a perspective view showing a preferred embodiment of the hair-winding tool of the present invention. FIG. 2A is an enlarged sectional view taken along a line II (A)—II (A) of FIG. 1. FIG. 2B is an enlarged sectional view taken along a line II(B)—II(B) of FIG. 1.

A hair-winding tool 10 includes a hair-winding part 12 having a longitudinal direction and having a flat surface portion 12*a*. The entire hair-winding part 12 is configured in the shape of an approximately rectangular flat plate. That is, the entire flat surface portion 12*a* is constructed as the hair-winding part 12. The flat surface portion 12*a* is provided on one end portion and other main surfaces of the hair-winding part 12 and on both end surfaces in the widthwise direction thereof. The hair-winding part 12 has a curved portion 14 provided at both side portions in the widthwise direction such that the curved portion 14 is located in a central region in a longitudinal direction of the hair-winding tool 10. The curved portion 14 is curved gently from the outer side portion to the inner side portion of the hair-winding part 12.

As shown in FIG. 1, the hair-winding part 12 includes a bow-shaped opening 12*b* at each end portion thereof in its longitudinal direction. A hollow portion 12*c* communicating with the opening 12*b* is provided inside the hair-winding part 12 to allow the hair-winding part 12 to be lightweight. The hair-winding part 12 included a plurality of circular small through-holes 16 formed on both end surfaces and the main surface thereof.

The opening 12*b*, the hollow portion 12*c*, and the small through-hole 16 communicate with one another. Thus, in performing cold wave by using the hair-winding tool 10 of the preferred embodiment, a first liquid of a cold wave permanent lotion, including a reducing agent and an alkalinizing agent, and a second liquid of a cold wave permanent lotion, including an oxidizing agent, are able to flow through the hair-winding tool. Consequently, the first and second liquids of the cold wave permanent lotion permeate sufficiently into hair, thus allowing effective formation of a hair wave.

As shown in FIGS. 2A and 2B, the hair-winding part 12 has two rectangular reinforcing ribs 18*a*, 18*b* extending in its longitudinal direction and a rectangular reinforcing rib 18*c* extending in its widthwise direction.

The hair-winding part 12 has a rotation-supporting part 20 provided at both end portions in its longitudinal direction to rotatably support the hair-winding part 12. The rotation-supporting part 20 includes an approximately cylindrical member 22. The cylindrical member 22 has two small rectangular plate portions 22*a* and two small arch-shaped plate portions 22*b*. Six engaging claws 24 extend from an axial end of the cylindrical member 22 such that they are circumferentially spaced at desired intervals. The six engaging claws 24 are provided integrally with the cylindrical member 22. An approximately U-shaped groove 26 is provided in each space between the adjacent engaging claws 24.

In the hair-winding tool 10 of this preferred embodiment, the hair-winding part 12 and the rotation-supporting part 20 are composed of a synthetic resinous material. The hair-winding part 12 and the rotation-supporting part 20 may be formed integrally, or separately and then connected with each other.

Figure 3:
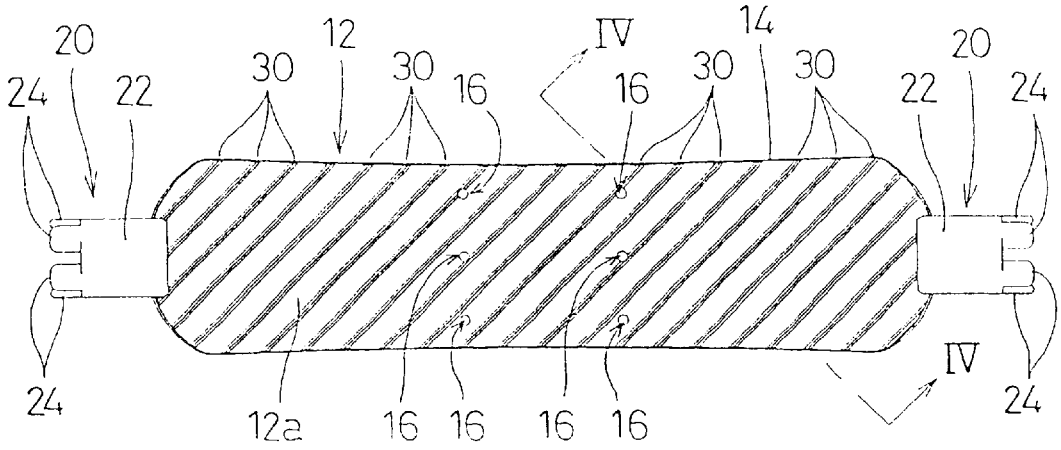
FIG. 3 is a plan view showing another preferred embodiment of the hair-winding tool of the present invention.
Figure 4:
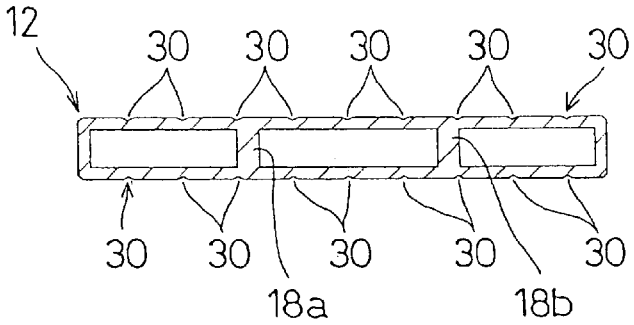
FIG. 4 is an enlarged sectional view taken along a line IV—IV of FIG. 3.

FIG. 3 is a plan view showing another preferred embodiment of the hair-winding tool of the present invention. FIG. 4 is an enlarged sectional view taken along the line IV—IV of FIG. 3. Unlike the hair-winding tool of the above-described preferred embodiment, the hair-winding too 110 shown in FIG. 3 has a plurality of passages provided on the hair-winding part 12 to allow the first and second liquids of the cold wave permanent lotion to flow more effectively.

Figure 5:
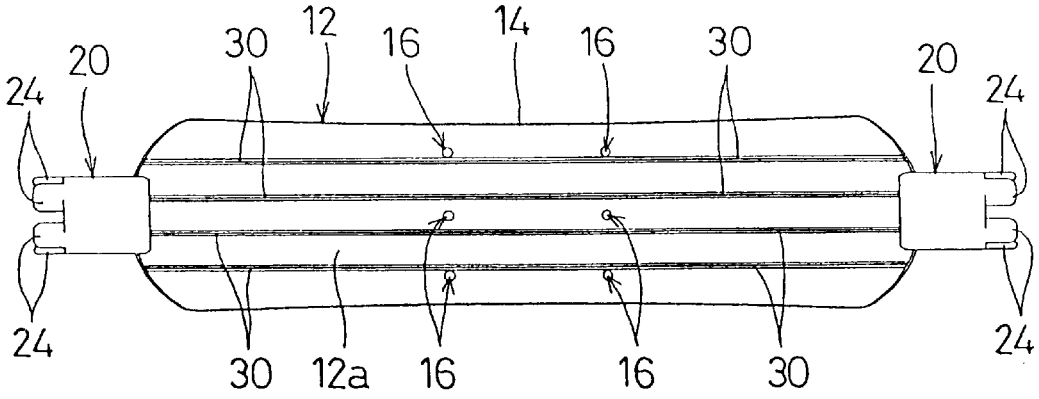
FIG. 5 is a plan view showing another preferred embodiment of the hair-winding tool of the present invention.

In the hair-winding tool 10 of FIG. 3, a plurality of V-shaped grooves 30, serving as passages, are provided at regular intervals on both main surfaces of the hair-winding part 12. In this case, the grooves 30 extend in a direction in which they intersect obliquely with the axis of the hair-winding part 12. The grooves 30 may also be provided such that they are parallel with the axis of the hair-winding part 12, as shown in FIG. 5. The grooves 30 are in cooperation with the opening 12*b* and the hollow portion 12*c* of the hair-winding part 12 to allows the first and second liquids of the cold wave permanent lotion to flow more effectively. Similar to the groove 30, the opening 12*b* and the hollow portion 12*c* serve as passages.

The method of forming a hair wave by using the hair-winding tool 10 of the preferred embodiments of the present invention will be described below with reference to FIGS. 1, 2, 3, 6, 7, 8, 9, and 10. The hair-winding tool 10 of the present invention is used for cold wave. The hair waving method to be carried out by the cold wave is described below.

Figure 6:
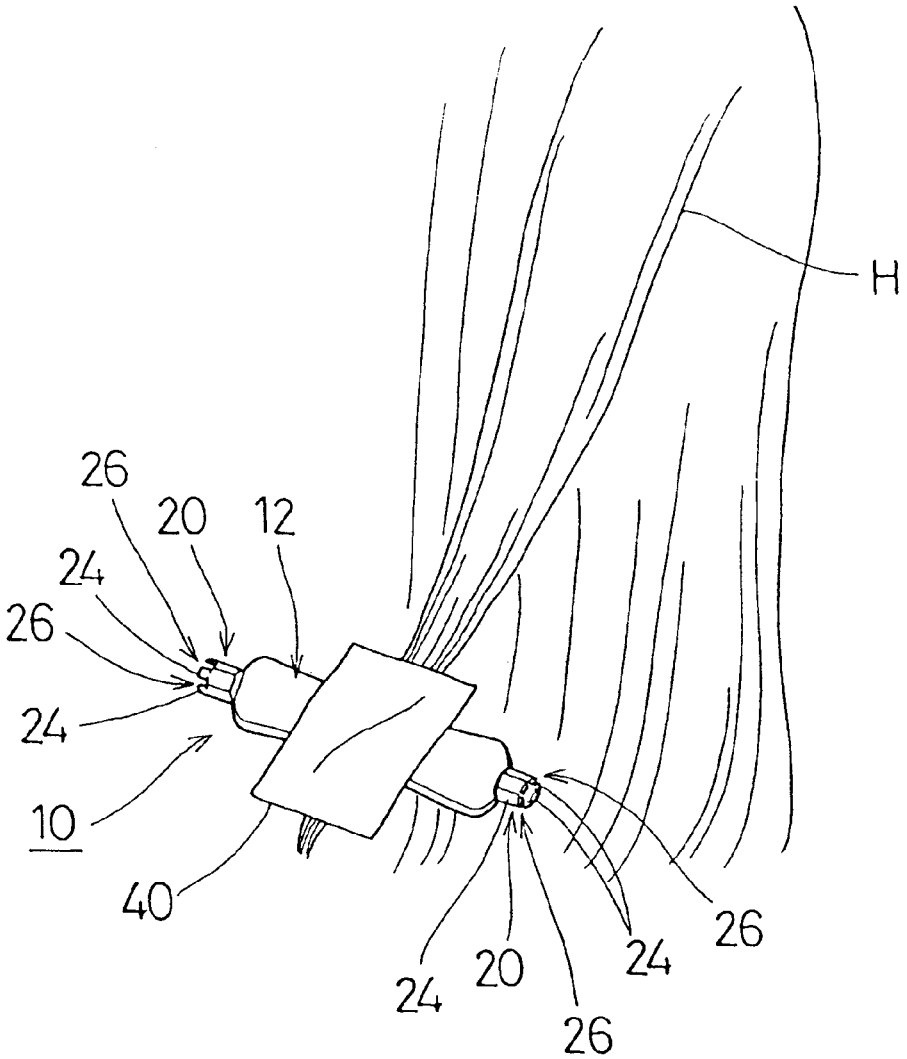
FIG. 6 is a perspective view showing an initial step of the hair-waving method according to a preferred embodiment of the present invention to be carried out by using the hair-winding tool of the present invention, namely, a state in which the tip portion of hair is sandwiched between the hair-winding tool and a sheet of paper.

Initially, as shown in FIG. 6, wet hair H is inserted between the hair-winding tool 10 and a sheet of paper 40 to sandwich the tip portion of the hair H therebetween.

Figure 7:
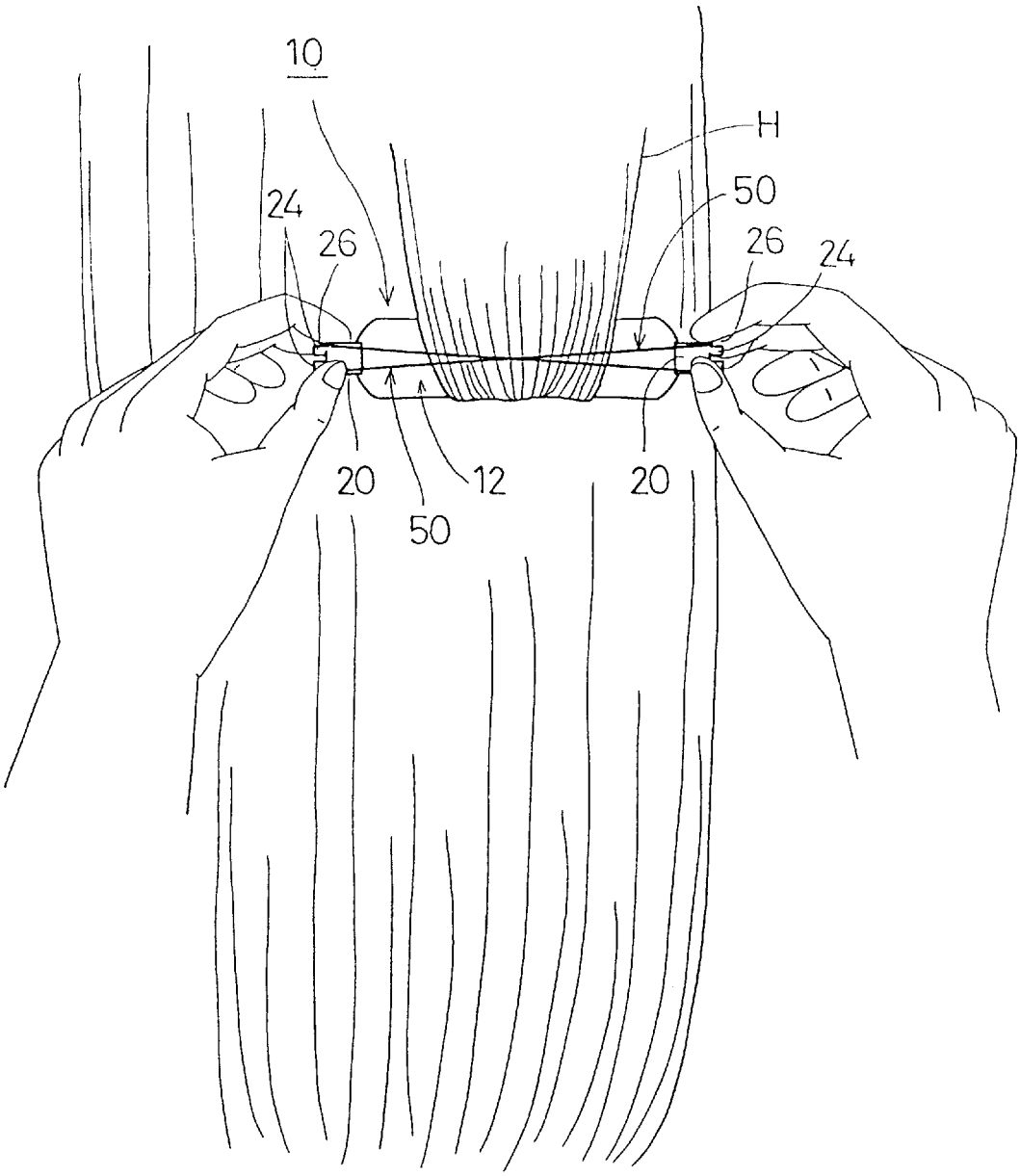
FIG. 7 is a perspective view showing a middle step of the hair-waving method according to a preferred embodiment of the present invention to be carried out by using the hair-winding tool of the present invention, namely, a state in which after the hair and the paper are wound around a hair-winding part, a holding member such as a rubber band is engaged to both ends of the hair-winding tool to fixedly hold the hair on the hair-winding part.
Figure 8:
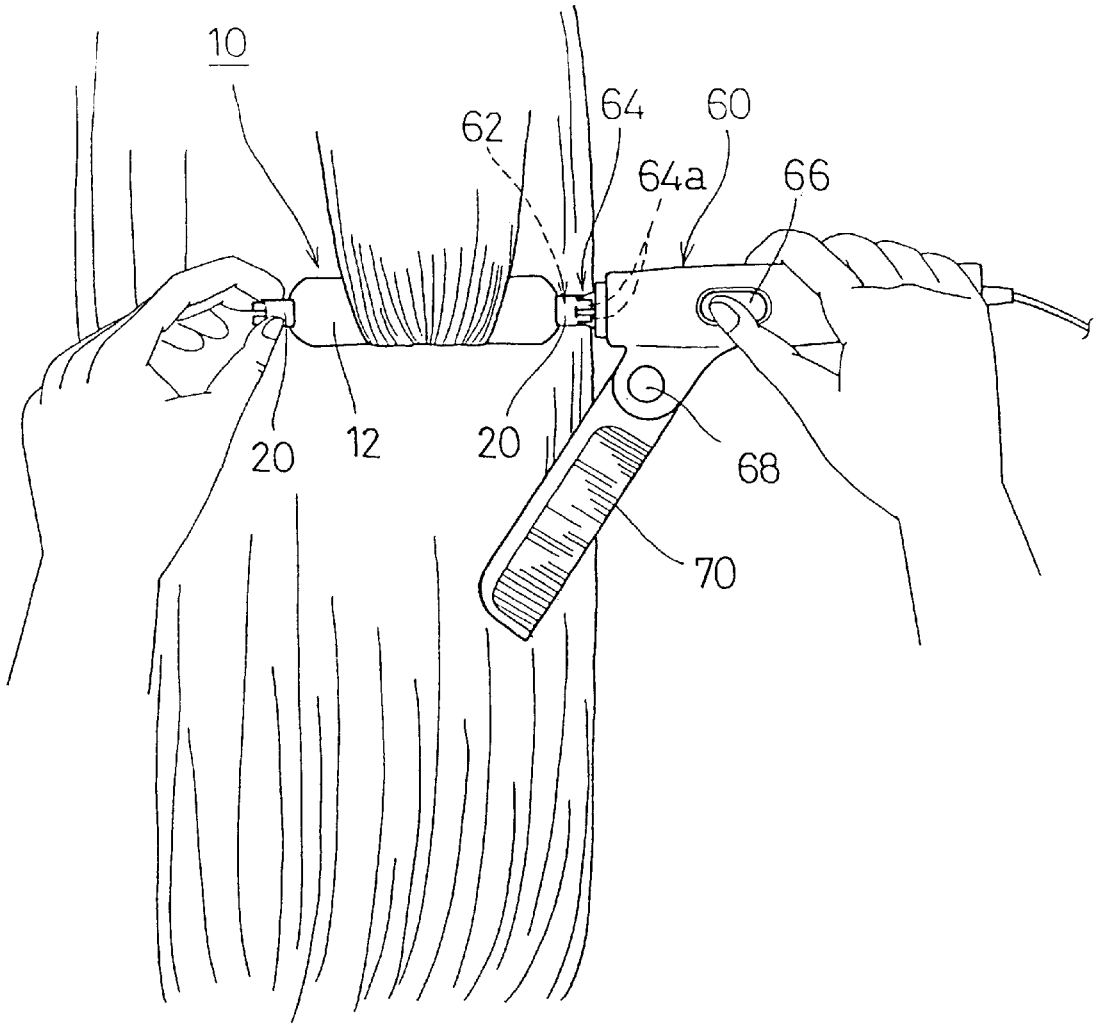
FIG. 8 is a perspective view showing another preferred embodiment of the hair-winding process shown in FIG. 7, namely, a state in which the hair and the paper are wound around the hair-winding part by rotating the hair-winding tool with an electromotive hair-winding device.

Then, the hair H and the paper 40 are wound around the hair-winding part 12 of the hair-winding tool 10. In this case, as shown in FIG. 7, the rotation-supporting part 20 supporting the hair-winding part 12 is rotated in a desired direction by gripping the rotation-supporting part 20 to move the hair-winding part 12 toward the root of the hair H, until a desired amount of the hair H is wound thereon. Instead of winding the hair H on the hair-winding part 12, an electromotive hair-winding device 60 shown in FIG. 8 may be used to automatically wind the hair H thereon.

The electromotive hair-winding device 60 incorporates a motor (not shown). A rotation shaft 62 is connected to a driving shaft (not shown) of the motor. A chucking portion 64 is rotatably provided in the vicinity of the root of the rotation shaft 62. The engaging claw 24 provided on the rotation-supporting part 20 of the hair-winding tool 10 is rotatably fitted in a plurality of engaging grooves 64*a* formed on the chucking portion 64. The electromotive hair-winding device 60 has a pivotal comb portion 70 provided there on through a pivotal portion 68. A switch button 66 of the electromotive hair-winding device 60 is turned on and off to rotate and stop the rotation shaft 62 and the chucking portion 64. Thereby, the hair-winding part 12 is rotated and stopped.

When the electromotive hair-winding device 60 is used to wind the hair H on the hair-winding tool 10, one rotation-supporting part 20 of the hair-winding tool 10 is gripped and the engaging grooves 64*a* are fitted in the other rotation-supporting part 20.

After the stage of winding the hair H on the hair-winding part 12 terminates, an annular elastic holding member 50, such as a rubber band, or other suitable holding member, is engaged to the groove 26 disposed in each space between the adjacent engaging claws 24 of the rotation-supporting part 20 to prevent the hair H from unwinding. The holding member 50 presses the hair H against the hair-winding part 12, thus retaining it thereon. Therefore, the hair H is fixed to the hair-winding part 12 in the wound state. In this manner, wisps of hair H are sequentially wound on the hair-winding tools 10, as shown in FIG. 9.

Figure 9:
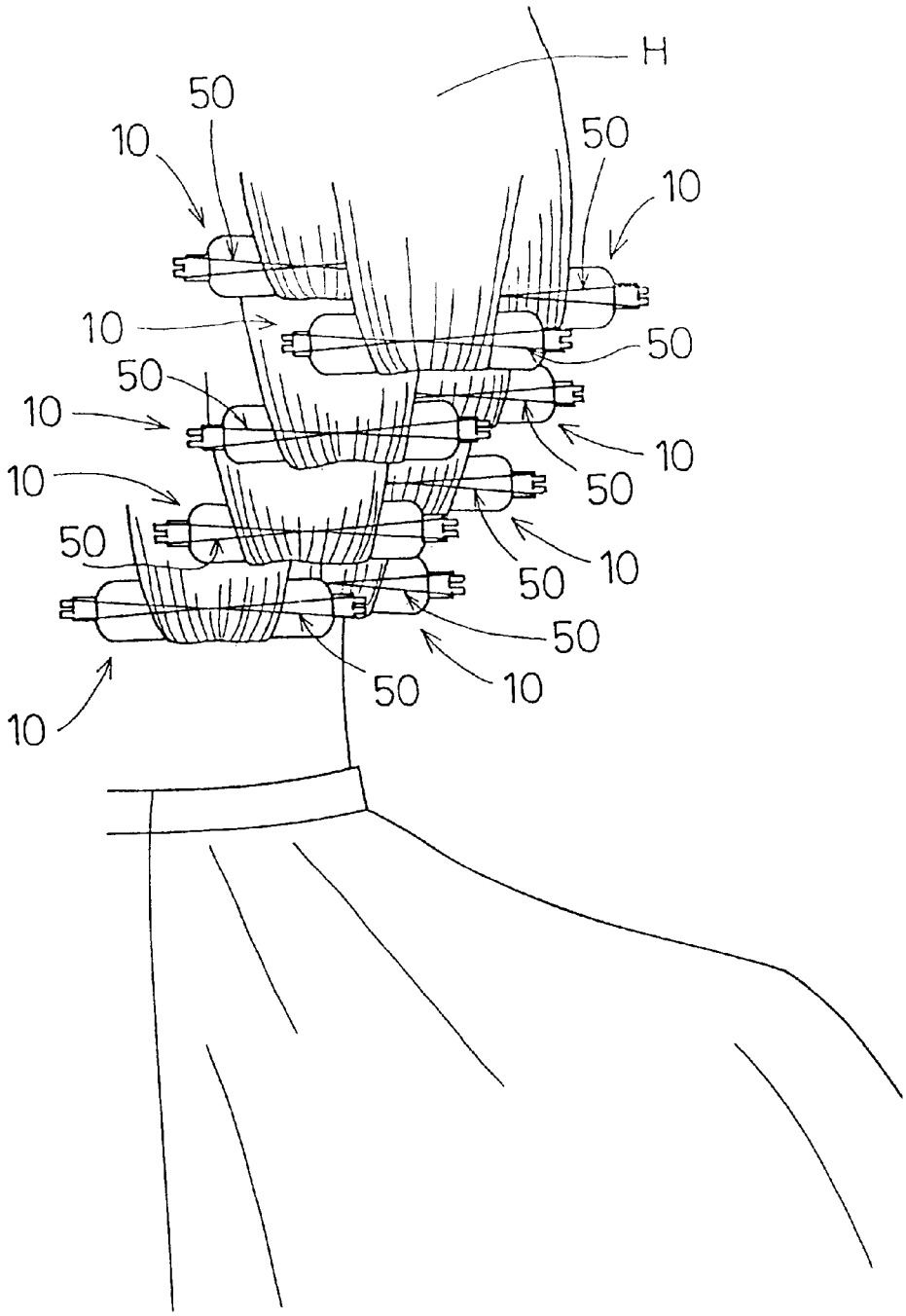
FIG. 9 is a perspective view showing a middle step of the hair-waving method according to a preferred embodiment of the present invention to be carried out by using the hair-winding tool of the present invention, namely, a state in which the entire hair is wound around a plurality of the hair-winding parts.
Figure 10:
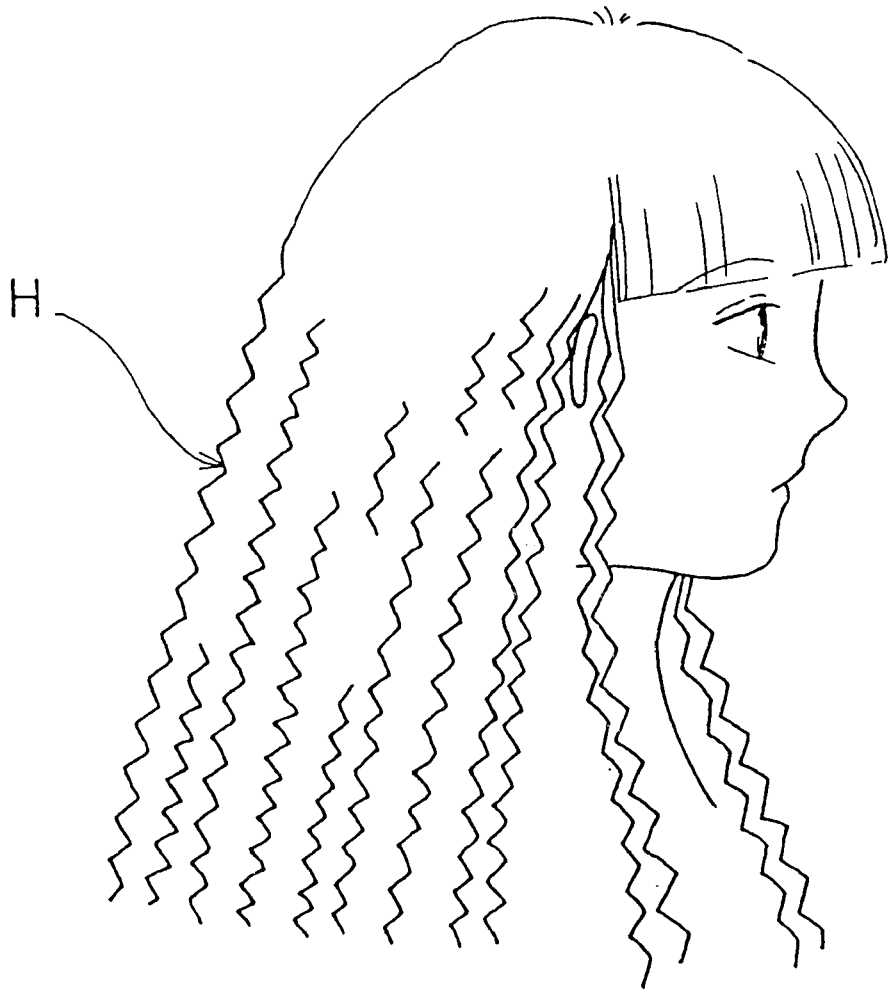
FIG. 10 is a schematic perspective view the zigzag hair wave formed by the hair-waving method according to preferred embodiments of the present invention.

Then, as shown in FIG. 9, the first liquid of the cold wave permanent lotion is applied to the hair H, with the wisps of the hair H wound on a plurality of the hair-winding tools 10. After the hair H is covered with a hair cap, the hair H is left for 10–15 minutes. To check the state of cold-waved hair H, namely, to examine the degree of the wave, two or three hair-winding tools 10 are removed from the cold-waved hair H. If the state of the cold-waved hair H is favorable, the hair cap (not shown) is removed therefrom. Then, the first liquid is washed away from the hair H. Subsequently, the second liquid is applied to the entire hair H, the hair H is covered with the hair cap (not shown) again. Then, the hair H is left for 10 –15 minutes. Thereafter, all the hair-winding tools 10 are removed from the hair H. Then, the second liquid is washed away from the hair H. Finally, the entire hair H is blow-dried to fix the cold permanent wave. In this manner, as shown in FIG. 10, the hair H is cold-waved zigzag, i.e., a novel hairdo is achieved.

In the above-described embodiments, the hair-winding part 12 is configured in the shape of a rectangular plate. However, the hair-winding part 12 of the hair-winding tool 10 is not limited to the rectangular shape. The hair-winding part 12 is required to have a flat surface portion in at least a part thereof. Accordingly, the hair winding part 12 may be plate-shaped or pillar-shaped, and sectionally polygonal, such as triangular, rectangular, pentagonal or hexagonal.

The present invention provides the hair-winding tool for forming the novel zigzag hair and the hair-waving method using it.

It will be apparent form the foregoing that, while the invention has been described in detail and illustrated, there are only particular illustrations and examples and the invention is not limited to these, the spirit and scope of the invention is limited only by the appended claims.

What is claimed is:

1. A hair-winding tool for cold wave treatment, comprising:

a hair-winding part having a longitudinal direction, two major flat surface portions, and a side wall connecting the two major flat surface portions;

at least one opening provided in said side wall at each end of the hair-winding part;

at least one hollow portion communicating with said at least one opening provided in said side wall at each end of the hair-winding part; and a plurality of through-holes provided in at least one of said two major flat surface portions and arranged to apply a cold wave permanent lotion used in cold wave treatment to hair via the hair-winding tool.

2. A hair-winding tool according to claim 1, further comprising:

a pair of rotation-supporting parts provided at both ends of said hair-winding part in a longitudinal direction thereof and rotatably supporting said hair-winding part; wherein each of said rotation-supporting parts includes an engaging portion to engage an annular and elastic holding member thereto.

3. A hair-winding tool according to claim 2, wherein said hair-winding part is configured in the shape of an approximately rectangular flat plate, and said pair of rotation-supporting parts include a cylindrical member and said engaging portion includes a plurality of engaging claws disposed on an axial end of said cylindrical member such that said engaging claws are spaced at desired intervals.

4. A hair-winding tool according to claim 1, wherein said hair-winding part has a passage provided thereon to allow a cold wave permanent lotion used in cold wave treatment to flow along the hair-winding part.

5. A hair-winding tool according to claim 2, wherein said hair-winding part has a passage provided thereon to allow a cold wave permanent lotion used in cold wave treatment to flow along the hair-winding part.

6. A hair-winding tool according to claim 3, wherein said hair-winding part has a passage provided thereon to allow a cold wave permanent lotion used in cold wave treatment to flow along the hair-winding part.

7. A hair-winding tool according to claim 1, wherein said hair-winding part includes a curved portion provided at side portions in a widthwise direction such that the curved portion is located in a central portion in the longitudinal direction of the hair-winding part, the curved portion being curved from the ends of the hair-winding part to the central portion such that the width of the ends of the hair-winding part is greater than the width of the central portion.

8. A hair-winding tool according to claim 4, further comprising:

a plurality of grooves provided on said at least one major flat surface portion of the hair-winding part, said plurality of grooves cooperating with the plurality of openings and the hollow portion of the hair-winding part to define the passage to allow the cold wave permanent lotion to flow more effectively.

9. A hair-waving method, comprising the steps of:

winding hair on a hair-winding part of a hair-winding tool according to claim 1; and performing cold wave treatment for said hair wound on said hair-winding part in said hair-winding step to form a zigzag hair wave.

10. A hair-waving method, comprising the steps of:

winding hair on a hair-winding part of a hair-winding tool according to claim 2; and performing cold wave treatment for said hair wound on said hair-winding part in said hair-winding step to form a zigzag hair wave.

11. A hair-waving method, comprising the steps of:

winding hair on a hair-winding part of a hair-winding tool according to claim 3; and performing cold wave treatment for said hair wound on said hair-winding part in said hair-winding step to form a zigzag hair wave.

12. A hair-waving method, comprising the steps of:

winding hair on a hair-winding part of a hair-winding tool according to claim 4; and performing cold wave treatment for said hair wound on said hair-winding part in said hair-winding step to form a zigzag hair wave.

13. A hair-waving method, comprising the steps of:

winding hair on a hair-winding part of a hair-winding tool according to claim 5; and performing cold wave treatment for said hair wound on said hair-winding part in said hair-winding step to form a zigzag hair wave.

14. A hair-waving method, comprising the steps of:

winding hair on a hair-winding part of a hair-winding tool according to claim 6; and performing cold wave treatment for said hair wound on said hair-winding part in said hair-winding step to form a zigzag hair wave.

* * * * *